US006474423B2

(12) United States Patent
Wood

(10) Patent No.: US 6,474,423 B2
(45) **Date of Patent: *Nov. 5, 2002**

(54) DRILL BIT (A)

(76) Inventor: Roy W. Wood, 119 Persimmon St., Birmingham, AL (US) 35214

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 34 days.

(21) Appl. No.: 09/345,786

(22) Filed: Jul. 1, 1999

(65) Prior Publication Data

US 2001/0047888 A1 Dec. 6, 2001

(51) Int. Cl.[7] ..... E21B 7/22
(52) U.S. Cl. ..... 175/323; 175/325.5; 175/340
(58) Field of Search ..... 175/323, 325.5, 175/340, 325.1, 325.2; 166/241.6

(56) References Cited

U.S. PATENT DOCUMENTS 4,533,005 A * 8/1985 Morris ..... 175/393
4,540,055 A * 9/1985 Drummond et al. ..... 175/323
4,541,494 A * 9/1985 Drummond et al. ..... 175/228
4,727,943 A * 3/1988 Wood ..... 175/229
4,874,045 A * 10/1989 Clayton ..... 175/323
5,474,143 A * 12/1995 Majkovic ..... 175/323
5,967,244 A * 10/1999 Arfele ..... 175/340
6,098,728 A * 8/2000 Wells et al. ..... 175/340

* cited by examiner

*Primary Examiner*—William Neuder
(74) *Attorney, Agent, or Firm*—John K. Donaghy

(57) ABSTRACT

A drill bit for drilling into earth formations comprising an elongated body having spiral contoured stabilizers for up to a 360-degree stabilization to protect the cutting cones, the elongated body has multiple adjustable openings or nozzles to direct the pressurized fluid medium first to the cutting cone area and bottom of the drill hole to convey the dust and cuttings up the bore hole, a second, adjustable opening or nozzle adds more pressurized fluid means spirally up the contoured annular area in the stabilizer area, and a third, adjustable opening or nozzle at the upper end of the contoured stabilizer to add more pressurized fluid means in the drill pipe annular area to convey the dust and cuttings to the surface of the bore hole, the elongated body has replaceable cutting cones, and bearings and shank assemblies for rebuilding to original specifications.

8 Claims, 2 Drawing Sheets

DRILL BIT (A)

BACKGROUND OF THE INVENTION

1. Field of Invention

This invention pertains to a drill bit with spiral stabilizer unit for drilling bores into earth formations.

2. Background of the Prior Art

The prior art discloses drill bits attached to a rotary drilling system which includes hollow drill strings attached to a drilling device. The hollow drill string permits pressurized fluid medium such as mud, water or gaseous drilling fluid such as entrained air as a medium for conveying dust and cuttings to the surface of the bore hole. Such drill strings normally insert a drill bit stabilizer adapter between the drill bit and the drill string for cutting cone protection.

The drill bits of this invention have adjustable openings or nozzles to convey dust and cuttings from the bottom of the drill hole and cutting cone area to the surface of the bore hole.

Some prior art stabilizers have spiral stabilizer bars and openings or nozzles in them to convey dust and cuttings to the bore hole surface.

Representative of prior art devises patented by this inventor are U.S. Pat. Nos. 4,540,055; 4541,494 and 4,727,943.

SUMMARY OF THE INVENTION

There is a need for a drill bit which can function as its own stabilizer having up to 360-degree spiral stabilizer for providing maximum cutting cone protection. In this regard, this invention has a contoured spiral configuration to permit greater annular area for hole cleaning and reduce wear on the stabilizer. This configuration functions to allow extended life of the cutting members and to function as a propeller to propel cuttings away from the drill bit body and drill pipe to the wall of the bore hole by centrifugal force exerted by the pressurized fluid medium and the contour of the stabilizer annular area using the pressurized medium added to the flow by the lower and up hole adjustable openings or nozzles and again the pressurized medium added to the stream by the adjustable openings or nozzles at the top of the contoured stabilizer. This drill bit has a means for replacing worn cutting cones and bearings and return the bit to the original specifications.

It is therefore an object of this invention to provide a drill bit with self-stabilized cutting cones which are easily replaceable, as well as the bearings and stabilizer wear.

It is another object of this invention to provide a drill bit that eliminates the need for a state of the art stabilizer adapter in the drill string.

It is still another object of this invention to threadedly attach the stabilizer shank and drill bit unit directly to the drill string thereby eliminating downtime required when a separate stabilizer and bit are threadedly attached.

Another object of this invention to provide a spiral stabilizer that provides an up to 360-degree hole stabilization.

Another object of this invention is to offer various vertical angles on the spiral stabilizers to properly accommodate various rotating speeds.

Another object of the invention is to provide a one-piece cast contoured spiral stabilizer which provides more annular area for hole cleaning flow.

It is a further object of this invention to shape the contour of the drill bit so as to function in a way to have a propeller effect on the pressurized fluid medium and the dust cuttings flow to centrifugally convey the flow of cuttings toward the wall of the bore hole as opposed to a stabilizer on the drill pipe.

It is yet another object of this invention to provide adjustable openings or nozzles in the three different annular areas in the drill bit. First, an adjustable opening or nozzle is directed down hole to clean the cutting cones and the bottom of the drill hole and convey the cut materials up the contoured spiral area of the stabilizer members. Second, another adjustable opening or nozzle is tangentially located on the drill bit so as to add more pressurized fluid to the cuttings and fluid flow and provide propeller action and centrifugal force to the flow. Third, an adjustable opening or nozzle is located at the top of the spiral stabilizer to add more pressurized fluid to the flow of cuttings to further enhance the flow of the dust and cuttings up to the bore hole surface.

Another object of this invention is to provide a continuous flow of the required volume of pressurized fluid medium in the three different annular areas to effectually and efficiently convey the dust and cuttings without causing regrind, erosion and premature failure of the cutting structure known to occur by state of the art systems which introduces the entire volume of the pressurized fluid medium under the drill bit.

And another object of this invention to provide means known to those in the industry of replacing worn cutting cones, bearings and shanks to return the bit to its original specifications.

Still another object of this invention to provide original dimensions to the stabilizer wear surfaces.

These and other objects of the invention become apparent to those skilled in the art to which its invention pertains when reading the following specifications when taken in light of the annexed drawings.

DETAILED DESCRIPTION OF THE PREFERRED EMBODIMENT OF THE INVENTION

Figure 1:
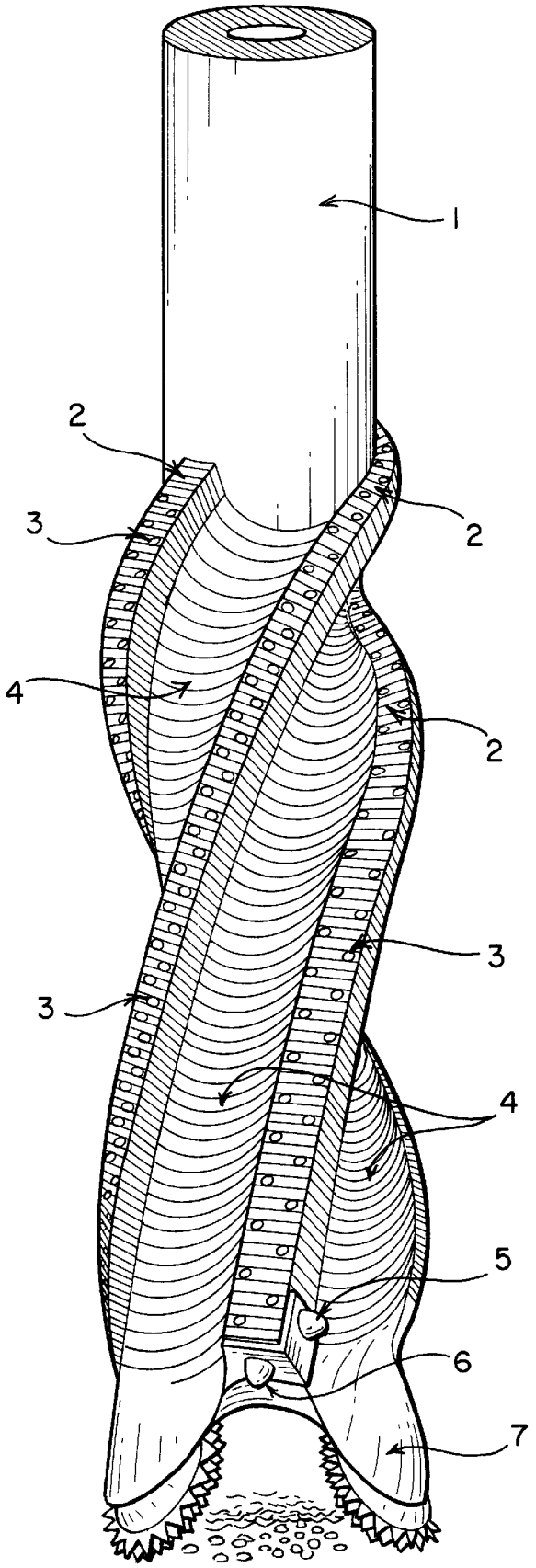
FIG. 1 is a perspective view of the drill bit of this invention showing the spiral stabilizers, the contoured area, the opening or nozzle locations and cutting cones.
Figure 2:
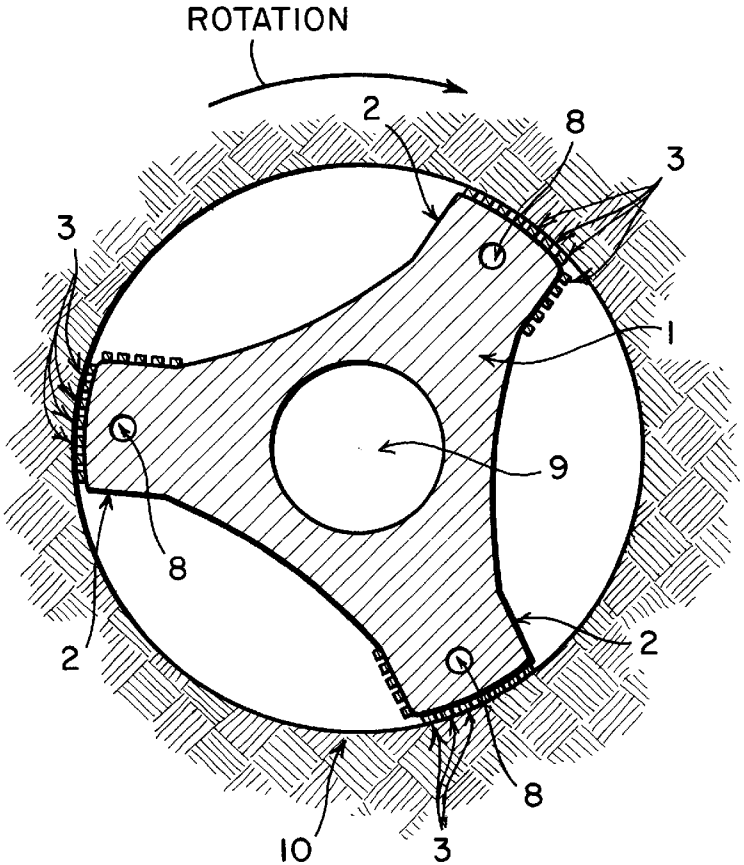
FIG. 2 is a cross section view of the contoured stabilizer wear surfaces situated in the bore hole which permits a propeller effect during rotation.

Turning now in more detail to the drawings, FIG. 1 shows a one-piece cast drill bit and stabilizer body 1 having threaded means A for connecting a drill string which is standard in the industry. The body 1 has contoured spirally arranged stabilizer wear bars 2 which have wear resistant inserts 3 which provide a means to retard destructive drill bit wear. The contoured areas 4 located between the wear bars 2 provide a propeller effect on the pressurized fluid and cuttings flow. Adjustable openings or nozzles 5 located between the cutting cones 7 function to clean the cutting cones 7 and the bottom of the drill hole (not shown) and convey the cuttings upwardly past the tangential adjustable openings or nozzles 5 and to add pressurized fluid medium to dust and cuttings flow in and along the contours 4 of the stabilizer and provide a propeller effect on the pressurized fluid and cuttings flow and cause heavier cuttings to spiral up the bore hole rather than along the contoured area 4 of the bit 1. Adjustable openings or nozzles 8, FIG. 2 located on the top end 13 of the stabilizer adds additional volume of pressurized fluid to the fluid, dust and cuttings. The openings or nozzles 8 are directed and coincident with the angle of the fluid, dust and flow to further provide acceleration of the heavier cuttings out to the wall 10 of the bore hole in a centrifugal manner and away from the drill pipe to spiral up the surface of the bore hole to the surface. Drill bit 1 has a hollow center 9, FIG. 2, providing means to deliver pressurized fluid medium through the drill string to the drill bit 1. Adjustable openings or nozzles 5, 6 and 8, FIGS. 1 and 2, provide three different annular areas for fluid medium. One nozzle is in the bit area in the bottom of the bore hole and is the smallest of the openings. The second nozzle is in the stabilizer area being the next largest nozzle and the third nozzle is the drill bit annular area 4 which is the largest area. This invention provides the means to introduce the volume of fluid needed to purge the different areas of the drill bit. Precisely controlling these volumes reduce state of the art problems of regrind, erosion and premature failure of the drill bit. The drill bit 1 provides a means to remove and replace cutting cones, bearings and engaging shanks 7 and return to original specifications as is well known to those in the industry.

Figure 3:
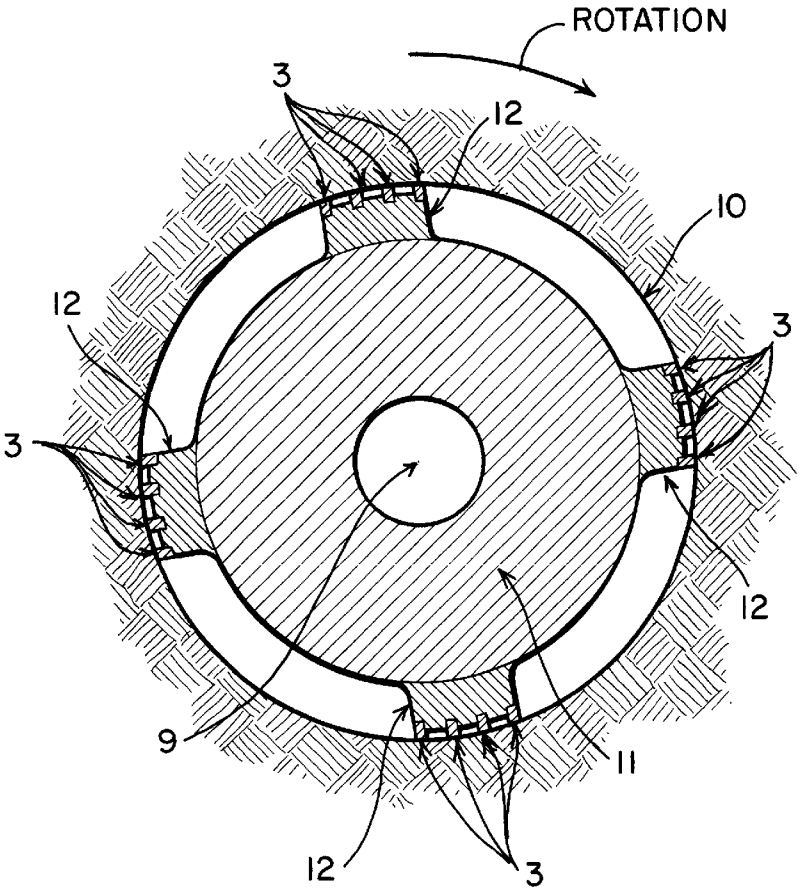
FIG. 3 is a cross section of general usage state of the art stabilizer and wear bars shown in bore hole.

State of the art stabilizers, FIG. 3, are generally but not always fabricated using commonly available pipe 11, FIG. 3 and bar stock 12, FIG. 3 with wear resistant inserts 3', FIG. 3 which is welded to the surface 4' of pipe 11. Those knowledgeable in the industry are aware of the drawbacks of this type stabilization, i.e., square corners 8' provide a cutting, dragging effect and are soon worn and beaten off by heavy cuttings and abrasive wear. The structure of this drill bit provides contoured stabilization areas which provides up to a 360-degree stabilization in the bore hole and thus provides longer useful life of the drill bit. Further, this degree dimension provides a propeller effect on the flow and is novel and effective means to preserve the drill bit and cutting cones.

What I claim is:

1. A drill bit comprising:

an upper portion and a lower portion;

said upper portion being threaded for attachment to a drill string;

said lower portion having means for cutting a bore hole in an earth formation;

spaced apart stabilizers spirally arranged on said lower portion providing stabilization in said bore hole;

a concave contoured annular area between said spirally arranged stabilizers;

adjustable nozzles providing pressurized fluid jets at multiple zones in said lower portion;

said adjustable nozzles being adjusted to provide the greatest volume and pressure of fluid at the bottom of said bore hole for cleaning and debris removal thereat with lesser volume and pressure at the mid-zone and upper zone levels for aiding in movement of debris and fluid to the surface by creating a propeller effect as the debris and fluid are forced up toward the surface through the concave contoured annular areas located between the spirally arranged stabilizers.

2. A drill bit according to claim 1 wherein said means for cutting a bore hole is at least one cutting cone on the lower portion.

3. A drill bit according to claim 1 wherein the bit is of a one-piece configuration.

4. A drill bit comprising:

an upper and a lower portion;

an upper portion attached to a drill string;

spaced apart spirally arranged stabilizers formed on the lower portion;

concave contoured annular areas located between said stabilizers;

adjustable nozzles provided at multiple zones directing pressurized fluid or liquid mediums downwardly into the bottom of a bore hole and upwardly toward the surface of the bore hole;

said adjustable nozzles for providing pressurized fluid jets at multiple zones in said lower portion being adjusted to provide the greatest volume and pressure of fluid at the bottom of said bore hole for cleaning and debris removal thereat and lesser volume and pressure at the mid-zone and upper zone levels for aiding in movement of debris and fluid to the surface by creating a propeller effect as the debris and fluid are forced up toward the surface through the concave contoured annular areas located between the spirally arranged stabilizers.

5. A drill bit according to claim 4 wherein said spaced apart stabilizers are raised above and are separated by said concave contoured annular area.

6. A drill bit according to claim 4 wherein said concave contoured annular areas are multiple concave contoured annular areas and said stabilizers are spirally arranged on the lower portion such that the concave contoured annular areas lay between the stabilizers.

7. A drill bit according to claim 6 wherein said concave contoured annular areas are spirally arranged and provide a propeller effect on the pressurized fluid and cuttings and propels them outwardly toward the wall of the bore hole.

8. A drill bit according to claim 4 wherein said spaced apart stabilizers have replaceable wear surfaces.

* * * * *